US010973291B2

(12) United States Patent
Holmgren

(10) Patent No.: US 10,973,291 B2
(45) Date of Patent: Apr. 13, 2021

(54) METHOD AND DEVICE FOR ESTABLISHING A PLACE OF REST FOR SMALL CHILDREN

(71) Applicant: JETKIDS AS, Algarheim (NO)

(72) Inventor: Halvor Holmgren, Jessheim (NO)

(73) Assignee: JETKIDS AS, Algarheim (NO)

( * ) Notice: Subject to any disclaimer, the term of this patent is extended or adjusted under 35 U.S.C. 154(b) by 242 days.

(21) Appl. No.: 15/315,542

(22) PCT Filed: Jun. 2, 2015

(86) PCT No.: PCT/NO2015/050098

§ 371 (c)(1),
(2) Date: Dec. 1, 2016

(87) PCT Pub. No.: WO2015/187033

PCT Pub. Date: Dec. 10, 2015

(65) Prior Publication Data

US 2017/0196326 A1 Jul. 13, 2017

(30) Foreign Application Priority Data

Jun. 2, 2014 (NO) ..... 20140682

(51) Int. Cl.
*A45C 9/00* (2006.01)
*A47C 17/82* (2006.01)
(Continued)

(52) U.S. Cl.
CPC ..... *A45C 9/00* (2013.01); *A45C 5/03* (2013.01); *A45C 5/14* (2013.01); *A47C 17/82* (2013.01); *A47D 7/002* (2013.01); *A47D 9/005* (2013.01)

(58) Field of Classification Search
CPC .... A45C 5/04; A45C 9/00; A45C 5/03; A45C 5/14; A45C 17/80; A47D 7/002; A47D 9/005
(Continued)

(56) References Cited

U.S. PATENT DOCUMENTS 275,991 A * 4/1883 Case ..... B61D 37/006
2,160,069 A 5/1939 Hawkins
(Continued)

FOREIGN PATENT DOCUMENTS

BE 373863 A 11/1930
CN 2240300 Y 11/1996
(Continued)

OTHER PUBLICATIONS

International Search Report and Written Opinion dated Oct. 9, 2015 (PCT/NO2015/050098).

*Primary Examiner* — Tri M Mai
(74) *Attorney, Agent, or Firm* — Alix, Yale & Ristas, LLP

(57) ABSTRACT

A device for providing a resting place for toddlers, partly on top of, partly in front of a seat in an object of public transportation. It comprises a suitcase, comprising of a trunk box and a reversible suitcase lid. The suitcase lid is in first position closed and suitable for transportation, while the suitcase lid in another, ready-to-use position, is upside down as compared with the first position and secured over, and to, the trunk box by means of an arranged attachment mechanism. The side of the lid which is facing upwards in the ready-to-use position, is substantially planar and thereby adapted to act as part of a bed base.

20 Claims, 3 Drawing Sheets

(51) Int. Cl.

| | |
|---|---|
| ***A45C 5/03*** | (2006.01) |
| ***A45C 5/14*** | (2006.01) |
| ***A47D 9/00*** | (2006.01) |
| ***A47D 7/00*** | (2006.01) |

(58) Field of Classification Search
USPC ..... 190/20, 19, 2; 280/35, 37, 47.26; 297/188.16, 188.19
See application file for complete search history.

(56) References Cited

U.S. PATENT DOCUMENTS

| | | | | | |
|---|---|---|---|---|---|
| 2,805,905 | A * | 9/1957 | Levitan | A47B 31/00 | 108/145 |
| 3,522,955 | A * | 8/1970 | Warner, Jr. | A45C 5/14 | 280/655.1 |
| 3,605,140 | A * | 9/1971 | Wanner | A47C 17/82 | 5/113 |
| 4,889,257 | A | 12/1989 | Steffes | | |
| 4,984,813 | A * | 1/1991 | Takahashi | B62B 7/12 | 220/212 |
| 5,425,545 | A * | 6/1995 | McCusker | B62B 3/02 | 280/30 |
| 5,562,331 | A | 10/1996 | Spykerman et al. | | |
| 5,860,281 | A | 1/1999 | Coffee et al. | | |
| 5,979,927 | A * | 11/1999 | Hale | G02B 7/182 | 248/277.1 |
| 6,193,033 | B1 * | 2/2001 | Sadow | A45C 5/14 | 16/405 |
| 6,282,084 | B1 * | 8/2001 | Goerdt | F16M 11/16 | 108/115 |
| 7,350,857 | B2 | 4/2008 | Bishop | | |
| 8,016,089 | B1 * | 9/2011 | McNichols | A45C 9/00 | 190/1 |
| 8,256,622 | B2 * | 9/2012 | Ahlberg | A47F 5/10 | 206/216 |
| 8,678,227 | B2 * | 3/2014 | Patstone | A45C 9/00 | 190/11 |
| 2003/0024043 | A1 * | 2/2003 | Rivera | A47K 1/02 | 4/654 |
| 2004/0130194 | A1 * | 7/2004 | Wroobel | B62B 3/144 | 297/256.17 |
| 2004/0239167 | A1 * | 12/2004 | Fisher | B60N 2/3065 | 297/331 |
| 2012/0222931 | A1 | 9/2012 | Zuckerman | | |
| 2013/0256072 | A1 * | 10/2013 | Farhat | A47C 4/52 | 190/2 |
| 2014/0070505 | A1 * | 3/2014 | Yi | B62B 9/087 | 280/47.38 |

FOREIGN PATENT DOCUMENTS

| | | | |
|---|---|---|---|
| CN | 202664538 | U | 1/2013 |
| CN | 203353863 | U | 12/2013 |
| GB | 2197207 | A | 5/1988 |
| GB | 2470347 | A | 11/2010 |
| WO | 2005055789 | A1 | 6/2005 |
| WO | 2010000406 | A1 | 1/2010 |

* cited by examiner

METHOD AND DEVICE FOR ESTABLISHING A PLACE OF REST FOR SMALL CHILDREN

BACKGROUND

The hereby disclosure concerns a device for establishing a place of rest for small children on board different means of public transport, like airplanes, train and bus. According to another aspect, a method for usage of the device is also disclosed.

Airplane travel is becoming more and more normal for many people. Many people travel with small children, and this can sometimes be troublesome. Children below the age of 2 are treated as infants in accordance with international air travel regulations, and should be seated on an adults lap during takeoff and landing. From the age of 2 years and upwards, they must be seated in their own seat. However, it is difficult to obtain a good place of rest for these children on long-haul flights. Some foreign airlines offer so-called "sky-cots" for long-haul flights, but these are difficult to obtain. There is also a hammock style infant bed, the FlyeBaby, which can be used for the purpose. But, both of these solutions become pretty much useless when the child grows older than 9-12 months. This is not adequate. What many people then do when they are traveling far, is that they buy a separate seat for their children below the age of 2, so that their child can lay down and sleep in this seat when they are airborne. Since the seatback does not allow much recline in most airplanes, they end up sleeping on the seat cushion, which is not very big or comfortable. Another option that is possible, is to bring the car seat for your child, and use this in the plane. This is no optimal solution, as car seats are large and cumbersome to bring through security etc. Some choose to lay the baby on the floor in front of the aircraft seat when the baby needs its sleep, but it is usually cold drafts and dirty down there, so it's rather not a good solution. And one has no good supervision of the child either.

Portable resting devices are known from a number of publications, such as CN 2013 203 82295, BE 373863, US 2012/0222831 and GB 2 197 207. None of these are however adapted, or suitable, for use on public transport, such as aircraft, with the very limited space there is available, while several of these admittedly in the deflated state has the shape of a suitcase which is convenient to bring along when traveling.

SUMMARY

Disclosed herein is a device that will enhance the possibilities for young children to obtain rest during transport in aircraft and possibly other means of public transport.

The disclosed device and method are so simple that each passenger has the opportunity to bring the necessary equipment along.

The described embodiments are explained and exemplified in relation to the use of aircraft, but a skilled professional in the field will understand that the same principle can be used on board the train, bus, certain types of boats, ferries or ships etc.

The disclosed device solves the need very easily with a unique reversible suitcase lid. The suitcase lid bottom and trunk box will together with the aircraft seat create a childbed, ranging from seatback to seatback, between the aircraft seat rows. The device can also be used to store travel items, as well as a suitcase that your child can use as a ride on suitcase. This is convenient for airports with long distances, as the child can sit on the suitcase and kick their legs to thrust forward. They can also be pulled by an adult. It can be taken through security checks without a problem, and can easily be stowed under the aircraft seat or in the overhead compartment when not in use. It is within the airline industry standardized measurements for hand luggage. The disclosed device allows people who travel with children up to approximately 3 years of age to use the suitcase bed function in an unoccupied aircraft seat so that the child can lie comfortably. The device can, like other suitcases, also be used for storing objects. It is therefore expected that it will naturally become the child's hand luggage during travel. It can also be put in front of the aircraft seat and be used as a footrest for children from age 3-6 years.

The disclosed embodiments are primarily designed for traveling by air, but can also be used in similar situations where you sit in rows (e.g. trains etc.).

The device is essentially a wheeled suitcase with a uniquely developed lid. The lid can be rotated and adjusted in different heights on top of the trunk box, and will create a horizontal surface in front of the seat cushion on a plane seat. An accompanying mattress will be put on top of the lid and the seat cushion of the aircraft seat, and these together, will create a horizontal surface extending from the seat back to the seat back, between two aircraft seat rows. The suitcase lid is secured in the trunk box standing on the floor in front of the aircraft seat. The trunk box typically has lockable wheels that prevent displacement, at least one wheel should be lockable (see 14 in FIG. 5). Both the trunk box and the suitcase lid consist of a relatively stiff material.

The disclosed device is uniquely operable with respect to the function of the suitcase lid. The upper side of the lid is preferably rounded so that the suitcase is comfortable to sit on, and ride on, for the child. The lower side of the suitcase lid is flat, and this side is facing up when using the bed feature. The suitcase lid can be flipped over and attached to the trunk box in a ready-to-use position as described below. By "ready-to-use" position means ready for use as a resting place/bed. To use the device as a childbed, the suitcase is placed on the floor in front of a passenger seat. The unique lid is then lifted up and turned around so that the flat underside is facing up. The lid is adjusted to the desired height, so that the lid flat side is at the height of the seat cushion of the aircraft seat. A folding mattress is then rolled out on top of the lid and the seat cushion, so that they together create a horizontal bed.

BRIEF DESCRIPTION OF THE DRAWINGS

In the following text, the invention is described with reference to the accompanying figures, in which.

DETAILED DESCRIPTION

Figure 1:
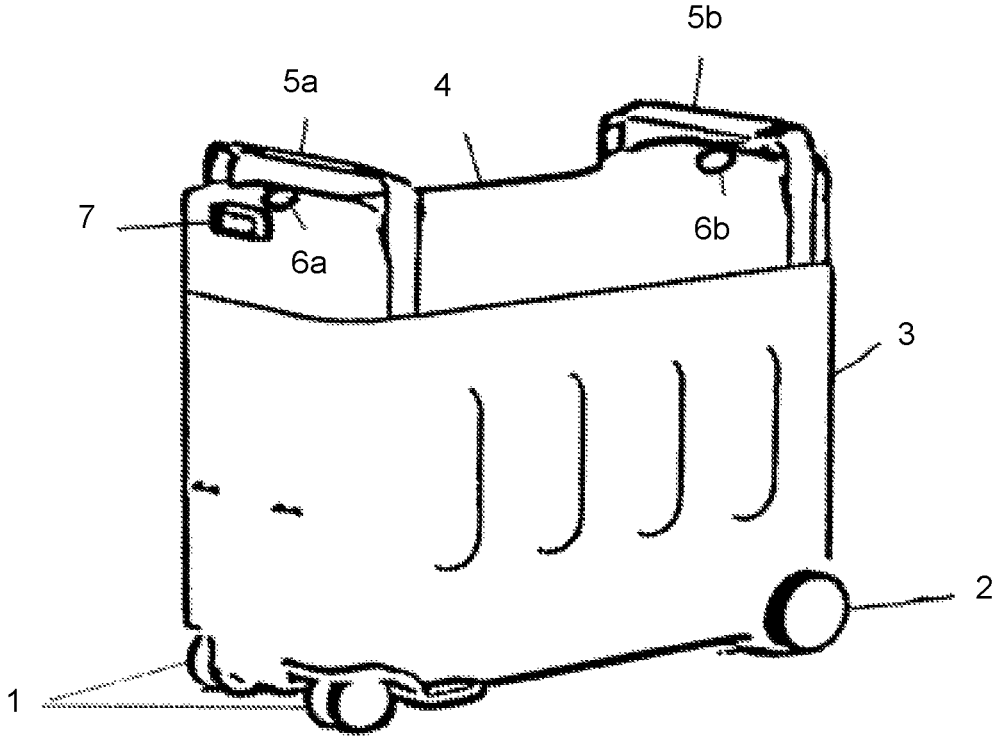
FIG. 1 shows in perspective, an embodiment of the disclosed device in closed position.

FIG. 1 shows an embodiment of the disclosed device, which in appearance is a wheeled suitcase with four wheels. The front wheels 1 has swivel, to be able to control the direction when rolling, while the rear wheels 2 has a fixed orientation. The suitcase comprises a trunk box 3, and a suitcase lid 4. The suitcase lid 4 has handles 5*a*, 5*b*, and two through holes 6*a*, 6*b* in the illustrated embodiment. On each side of the trunk box 3, substantially vertical rods 8*a*, 8*b* may be internally arranged. These are adapted to penetrate each of its holes 6*a*, 6*b*. This is to enable height adjustment of the suitcase lid 4 in ready-to-use position. The suitcase lid 4 is raised and lowered by pressing the two spring-loaded locking buttons 7 on the short sides of the suitcase lid 4. The vertical rods 8*a*, 8*b* may be permanent, and possibly with adjustable mounting in the trunk box 3, or the trunk box 3 can be provided with inner recesses, that the rods will fit in, and be placed in, after the lid is opened.

Figure 2:
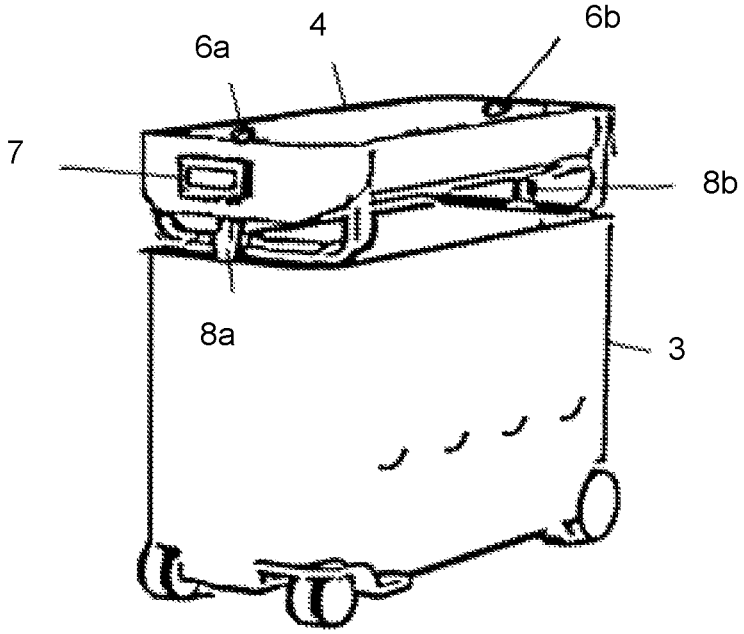
FIG. 2 shows a perspective view of the device of FIG. 1 in ready-to-use position.

FIG. 2 shows the device with the suitcase lid 4 inverted, which means the suitcase lid is turned 180 degrees about a horizontal axis compared to the first position. The suitcase lid's 4 flat underside is then turned up, and it is planar or substantially planar. The suitcase lid 4 is locked in the two vertical rods 8*a*, 8*b*, using a fixation which goes into effect when you release the lock button 7. The through holes 6*a*, 6*b* in the suitcase lid 4 allows the suitcase lid 4 to be used with the flat side both up and down. In ready-to-use position, the vertical rods 8*a*, 8*b* penetrates the suitcase lid 4.

Figure 3:
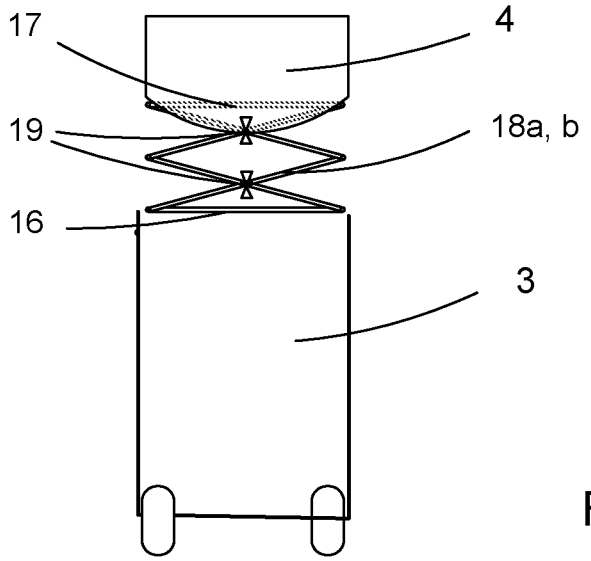
FIG. 3 shows in an end view, an alternative embodiment of the disclosed device.

FIG. 3 shows schematically, and very simplified, a device according to the disclosure, having an alternative attachment mechanism to the combination of the rods 8*a*, 8*b* and custom holes 6*a*, 6*b* which are shown in FIGS. 1 and 2. This alternative consists of an attachment mechanism 18*a*, 18*b* that each includes extendable intersecting struts which with purpose can be locked with locking bolts 19. A lower cross beam 16 may be attached in the suitcase, while an upper crossbeam 17 could be adapted to operate with a recess in the suitcase lid. It must be understood that there will be one such fastening mechanism 18*a* at one end of the suitcase, and another attachment mechanism 18*b* at the opposite end, similar to the rods 8*a*, respectively 8*b*. By extracting fastening mechanisms 18*a*, 18*b* to the desired level, and lock them, the desired height adjustment will be achieved.

It is described above that the said attachment mechanism, whether it includes vertical rods 8*a*, 8*b* or extendable cross bracings 18*a*, 18*b*, only operates with the suitcase lid 4 when the lid is facing with the substantially planar side up and the device is thus ready for use. But, the establishment of an attachment mechanism (not illustrated) which also cooperates with the lid in its closed position, could also very well be done. However, typically the lid is held in the closed position by means of conventional latches.

A skilled professional in the field will understand that other possibilities for the height adjustment is also present within the scope of the invention. An example of another method of height adjustment of the suitcase lid is the use of actuators and/or height adjustment by means of an electric, battery-powered motor.

Figure 4:
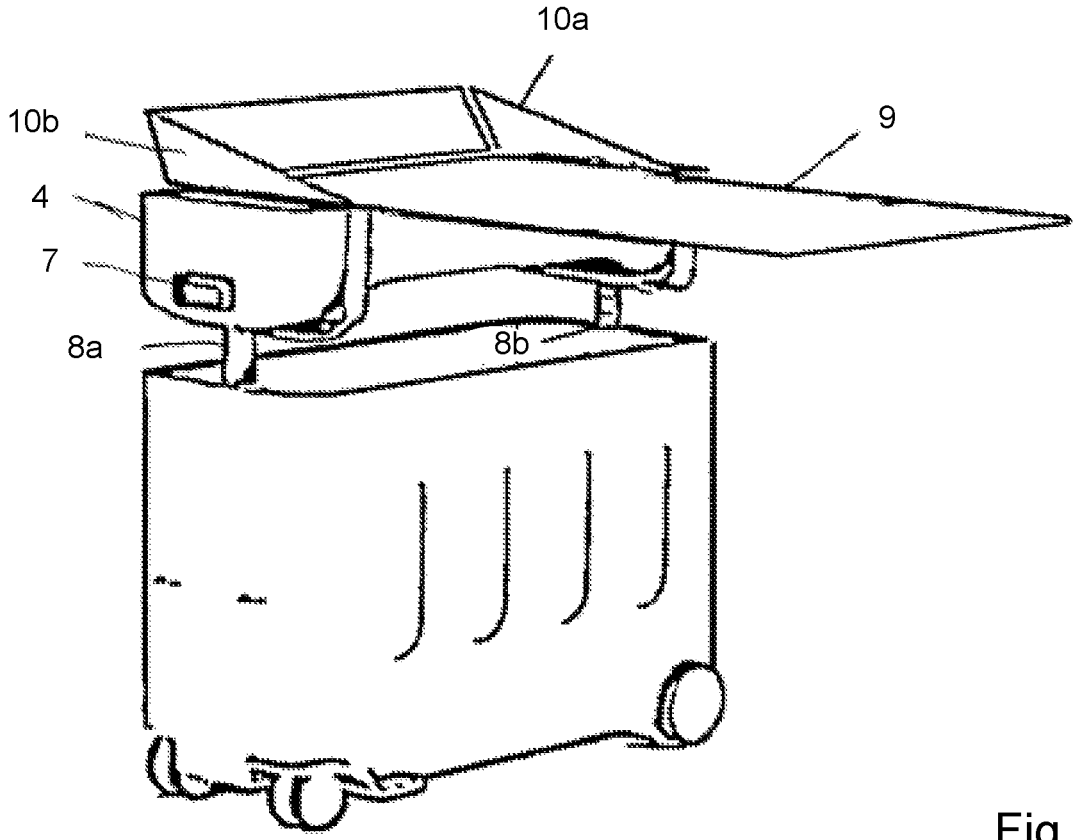
FIG. 4 shows in principle the same as FIG. 2*a*, but with additional equipment.

FIG. 4 shows the disclosed device with a mattress 9 on top. The mattress 9 can be rolled up and is shown with sidewalls 10*a*, 10*b* which is suitable to prevent the baby from rolling out. In this Figure, the suitcase lid 4 is fixed in position on the vertical rods 8*a*, 8*b*, using the latch in the lock buttons 7 on the suitcase lid 4 short sides.

Figure 5:
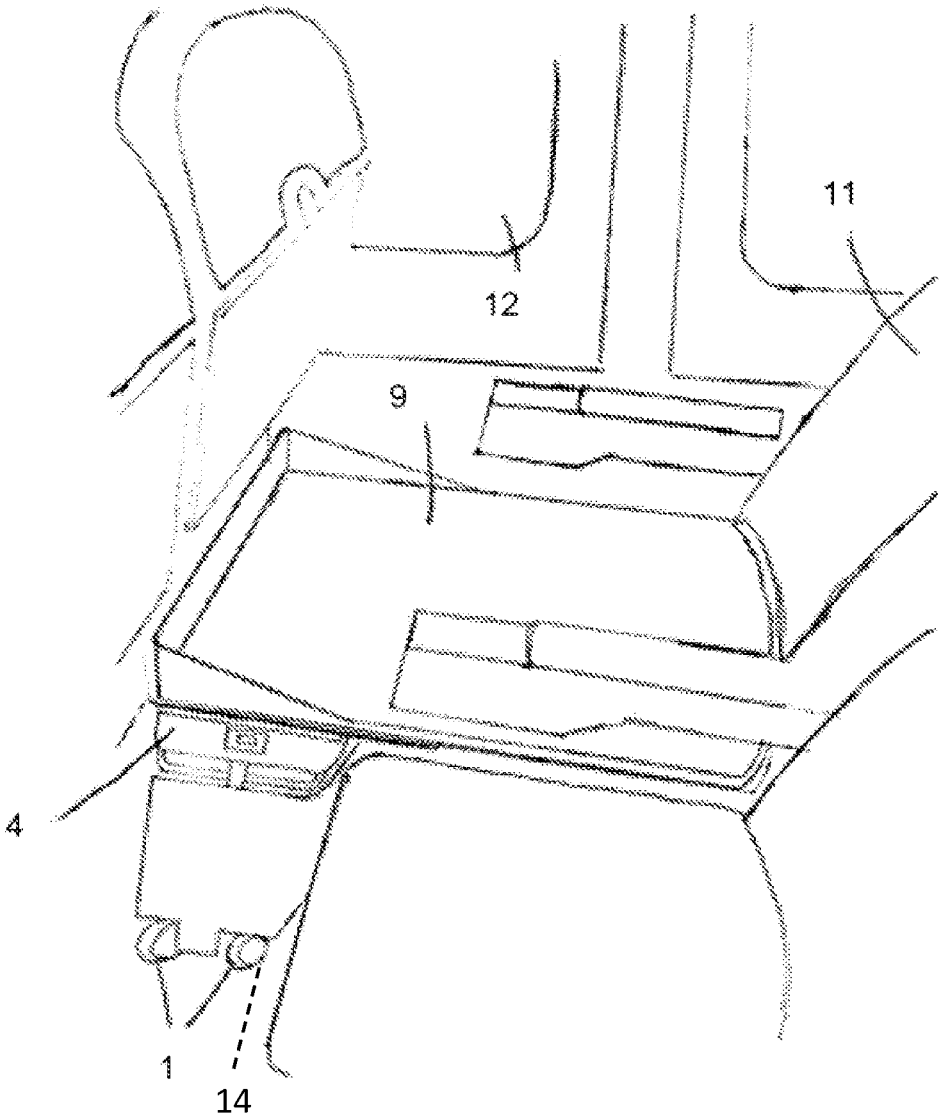
FIG. 5 shows a passenger seat, in which an embodiment of the disclosed device is placed in ready-to-use position.

FIG. 5 shows the disclosed device in front of an aircraft seat 11, in ready-to-use position. The device is here set up at the innermost aircraft seat, near a window 12. The mattress 9 is rolled out across the suitcase lid 4 flat side and also the seat cushion on the aircraft seat 11, to which the device is placed in front of. The wheels 1 are locked in position to prevent lateral displacement.

The invention claim is:

1. A device for establishing a place of rest for small children, partly on top of and partly in front of, a seat in an object of public transportation, the device having a form of a suitcase comprising:

a trunk box (3) having a front side, a rear side, and lateral sides between the front side and the rear side, and a turnable suitcase lid (4), wherein the suitcase lid (4) is movable between a first position, which is closed and arranged for transportation and a second position, which is turned upside down in relation to said first position and attached above the trunk box (3) via an attachment mechanism (8*a,b*; 18*a,b*) arranged therein, wherein said attachment mechanism comprises at least two vertical rods attachable to the suitcase lid (4), wherein each one of the at least two vertical rods is substantially centered between the lateral sides, said suitcase lid (4) having a height that is adjustable relative to the trunk box (3) in the second position, and the side of the suitcase lid (4) facing upwards in the second position being substantially flat and functional as a bed bottom, wherein the suitcase lid (4) is height adjustable via the attachment mechanism (8*a,b*; 18*a,b*).

2. The device of claim 1, wherein the suitcase lid (4) is fixated in the second position by means of said attachment mechanism.

3. The device of claim 2, wherein said attachment mechanism comprises at least two vertical rods (81, 8*b*) attachable to the suitcase lid (4).

4. The device of claim 1, wherein the at least two vertical rods (8*a*, 8*b*) penetrate the suitcase lid (4) in the second position.

5. The device of claim 1, comprising a plurality of wheels (1,2).

6. The device of claim 5, comprising four wheels (1,2).

7. The device of claim 5, wherein at least one of said wheels is lockable.

8. The device of claim 5, wherein two wheels of the plurality of wheels comprise front wheels, wherein the front wheels are proximate the front side of the trunk box, and wherein one of the at least two vertical rods is proximate the front side.

9. The device of claim 8, wherein two wheels of the plurality of wheels comprise rear wheels, wherein the rear wheels are proximate the rear side of the trunk box, and wherein one of the at least two vertical rods is proximate the rear side.

10. The device of claim 5, wherein two wheels of the plurality of wheels comprise front wheels, and wherein one of the at least two vertical rods is between the lid and the front wheels.

11. The device of claim 5, wherein two wheels of the plurality of wheels comprise rear wheels, and wherein one of the at least two vertical rods is between the lid and the rear wheels.

12. The device of claim 1, comprising a mattress (9) having a length corresponding substantially to the distance between two aircraft seats and a width corresponding substantially to the width of standard aircraft seat (1).

13. A method for establishing a place of rest for small children, partly on top of and partly in front of, a seat in an object of public transportation, comprising:

positioning a device as defined by claim 1 between two seats (11);

arranging the suitcase lid (4) in the second position, and adjusting the height of the suitcase lid (4) relative to the trunk box (3).

14. The method of claim 13, wherein the lid is fixated in the second position.

15. The device of claim 1, wherein the suitcase lid (4) is height adjustable in the second position via the attachment mechanism (8*a,b*; 18*a,b*).

16. The method of claim 13, wherein the suitcase lid (4) is height adjustable in the second position via the attachment mechanism (8*a,b*; 18*a,b*).

17. The device of claim 1, comprising a mattress (9) having a length corresponding substantially to the distance between two aircraft seats and a width corresponding substantially to the width of standard aircraft seat (11).

18. The method of claim 13, wherein the device comprises a mattress (9) having a length corresponding substantially to the distance between two aircraft seats and a width corresponding substantially to the width of standard aircraft seat (11).

19. A method for establishing a place of rest for small children, partly on top of and partly in front of, a seat in an object of public transportation, comprising:

positioning a device as defined by claim 1 between two seats (11);

arranging the suitcase lid (4) in the second position, and adjusting the height of the suitcase lid (4) according to the height of the seat (11) in front of which it is positioned.

20. The device of claim 1, wherein the turnable suitcase lid comprises a front side, a rear side, and lateral sides between the front side and the rear side, wherein the turnable suitcase lid further comprises a first lock button on the front side and a second lock button on the rear side, and wherein the at least two vertical rods are between the first lock button and the second lock button.

* * * * *